US006384791B1

(12) United States Patent
Ikeda et al.

(10) Patent No.: US 6,384,791 B1
(45) Date of Patent: May 7, 2002

(54) GPS RECEIVING ANTENNA WITH ENSURED MAGNET ATTRACTION AND FIRM MOUNTING OF ANTENNA BODY

(75) Inventors: Tomoki Ikeda; Tadaaki Onishi, both of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/837,692

(22) Filed: Apr. 18, 2001

(30) Foreign Application Priority Data

Apr. 20, 2000 (JP) ..... 2000-126241

(51) Int. Cl.[7] ..... H01Q 1/32
(52) U.S. Cl. ..... 343/713; 343/872
(58) Field of Search ..... 343/713, 700 MS, 343/711, 872

(56) References Cited

U.S. PATENT DOCUMENTS

| | | | | |
|---|---|---|---|---|
| 5,585,809 A | | 12/1996 | Yajima et al. | 343/713 |
| 5,706,015 A | | 1/1998 | Chen et al. | 343/700 MS |
| 5,757,327 A | * | 5/1998 | Yajima et al. | 343/713 |
| 5,900,840 A | | 5/1999 | Yajima | 343/713 |
| 5,943,018 A | | 8/1999 | Miller | 343/702 |
| 6,023,245 A | * | 2/2000 | Gomez et al. | 343/725 |

FOREIGN PATENT DOCUMENTS

| | | | |
|---|---|---|---|
| JP | 08148916 | 6/1996 | H01Q/1/22 |
| JP | 08148932 | 6/1996 | H01Q/21/29 |
| JP | 10135720 | 6/1998 | H01Q/1/22 |
| JP | Hei 10-190329 | 7/1998 | H01Q/1/24 |

* cited by examiner

*Primary Examiner*—Don Wong
*Assistant Examiner*—Hoang Nguyen
(74) *Attorney, Agent, or Firm*—Brinks Hofer Gilson & Lione

(57) ABSTRACT

A GPS receiving antenna is disclosed wherein a hole for communication between a recess portion and a receptacle portion is formed in a bottom wall with the recess portion formed therein and an adhesive is applied into the hole to bond an antenna body and a magnet with each other. Therefore, the adhesive does not protrude to the exterior of the recess portion, so that the appearance of the GPS receiving antenna is improved and a surface attraction of the magnet is ensured, thus ensuring a more positive mounting of the antenna than in the prior art.

2 Claims, 3 Drawing Sheets

GPS RECEIVING ANTENNA WITH ENSURED MAGNET ATTRACTION AND FIRM MOUNTING OF ANTENNA BODY

BACKGROUND OF THE INVENTION

1. Field of the Invention

The present invention relates to a GPS receiving antenna attached to the outside of a moving object such as a ship or an automobile to receive a radio wave generated from a GPS (Global Positioning System) satellite.

2. Description of the Prior Art

The configuration of a conventional GPS receiving antenna will now be described with reference to FIGS. 4 and 5. A box-shaped upper case 21, which is formed by molding a synthetic resin, comprises an upper wall 21*a*, side walls 21*b* extending from four sides of the upper wall 21*a*, a receptacle portion 21*c* surrounded by the upper wall 21*a* and side walls 21*b* and whose underside is open, and stepped portions 21*d* formed as recesses in and along the side walls 21*b*.

A box-shaped lower case 22, which is formed by molding a synthetic resin, comprises a bottom wall 22*a*, side walls 22*b* extending from four sides of the bottom wall 22*a*, a receptacle portion 22*c* surrounded by the bottom wall 22*a* and side walls 22*b* and whose upper side is open, stepped portions 22*d* formed as projections in and along the side walls 22*b*, and a pair of recess portions 22*e* each formed in the shape of a rectangular parallelepiped in the underside of the bottom wall 22*a*.

The upper and lower cases 21, 22 are combined together so that the receptacle portions 21*c* and 22*c* are opposed to each other and are mounted together by a suitable means.

As a result, a single receptacle portion is formed by the receptacle portions 21*c* and 22*c* and the stepped portions 21*d* and 22*d* are fitted together, with a packing being mounted in each of the thus-fitted portion to seal the interiors of the receptacle portions 21*c* and 22*c*. Thus, there is provided a waterproof configuration against the entry of water, etc.

An antenna body 24 is made up of: an earth plate 25; an antenna element 26 for receiving a radio wave from a GPS satellite, the antenna element 26 being provided on the surface side of the earth plate 25; a dielectric substrate 27 provided on the back side of the earth plate 25, with electric components (not shown) such as resistors, capacitors and IC parts being mounted on the substrate 27; and a shielding case 28 for shielding the dielectric substrate 27 electrically.

The antenna body 24 thus constructed is accommodated within the sealed receptacle portions 21*c* and 22*c* in such a manner that the shielding case 28 lies on the bottom wall 22*a* side of the lower case 22.

A waterproofing sleeve 30 is fitted on an outer surface of a coaxial cable 29 and the coaxial cable 29 is mounted in a state such that the sleeve 30 is sandwiched between the upper and lower cases 21, 22. The coaxial cable 29 is connected to the dielectric substrate 27 and is drawn out to the exterior.

A pair of magnets 31, each in the shape of a rectangular parallelepiped, are received respectively within the recess portions 22*e* of the lower case 22 and are attached to the lower case 22 with an adhesive 32 applied into the recess portions 22*e*.

By utilizing the magnetism of the magnets 31, the GPS receiving antenna thus constructed is attached by attraction to the outside of a moving object such as a ship or an automobile (the roof of an automobile, for example).

In the conventional GPS receiving antenna, since the adhesive 32 for mounting the magnets 31 is applied into the recess portions 22*e* of the lower case 22, the adhesive 32 applied to upper surfaces of the recess portions 22*e* is forced out to the exterior of the recess portions 22e by being pushed with the magnets 31, thus giving rise to the problem that not only the commercial value is impaired but also surface-attraction of the magnets 31 is obstructed by the thus-protruded adhesive 32, resulting in the mounting of the GPS receiving antenna becoming unstable.

Moreover, since the antenna body 24 is merely accommodated within the receptacle portions 21*c* and 22*c*, the mounting thereof is unstable and there occurs wobbling.

SUMMARY OF THE INVENTION

Accordingly, it is an object of the present invention to provide a GPS receiving antenna free of adhesive protrusion, capable of ensuring magnet attraction, and with an antenna body mounted firmly.

According to a first aspect of the present invention, there is provided a GPS receiving antenna comprising upper and lower cases; an antenna body received in a receptacle portion formed by the upper and lower cases; and a magnet received in a recess portion formed in a lower surface of a bottom wall of the lower case and bonded to the lower case with an adhesive, wherein a hole for communication between the recess portion and the receptacle portion is formed in the bottom wall in which the recess portion is formed, and the adhesive is applied into the hole to bond the antenna body and the magnet with each other.

According to a second aspect of the present invention there is provided, in combination with the above first aspect, a GPS receiving antenna wherein a depression is formed in the lower surface of the bottom wall opposed to the magnet so that the adhesive is present in the depression.

DETAILED DESCRIPTION OF PREFERRED EMBODIMENTS

Figure 1:
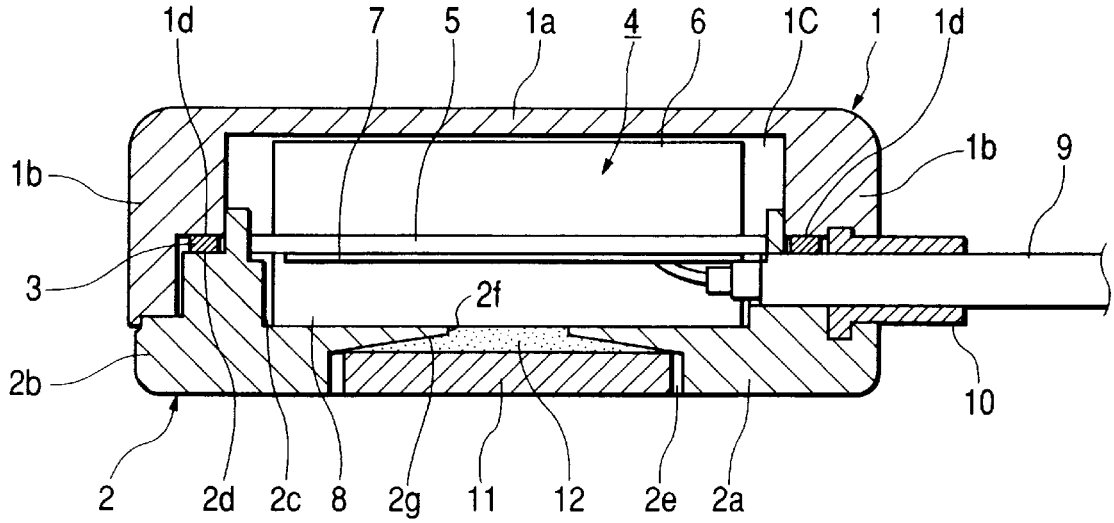
FIG. 1 is a sectional view of a principal portion of GPS receiving antenna according to the first embodiment of the present invention.
Figure 2:
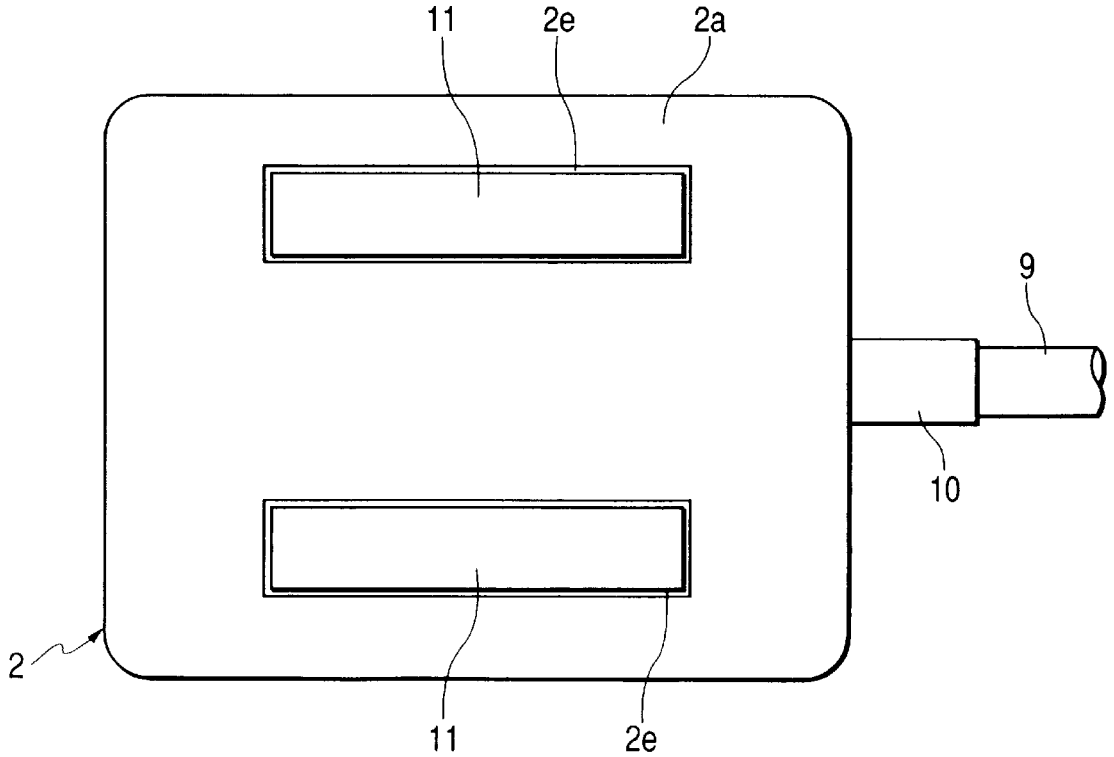
FIG. 2 is a bottom view thereof.

A GPS receiving antenna according to the first embodiment of the present invention will be described below with reference to FIGS. 1 and 2.

An upper case 1, which is formed in a box shape by molding a synthetic resin, comprises an upper wall 1*a*, side walls 1*b* extending from four sides of the upper wall 1*a*, a receptacle portion 1*c* surrounded by the upper wall 1*a* and the side walls 1*b* and whose underside is open, and stepped portions 1*d* formed as recesses in and along the side walls 1*b*.

A lower case 2, which is formed in a box shape by molding a synthetic resin, comprises a bottom wall 2*a*, side walls 2*b* extending from four sides of the bottom wall 2*a*, a receptacle portion 2*c* surrounded by the bottom wall 2*a* and the side walls 2*b* and whose upper side is open, stepped portions 2*d* formed as projections in and along the side walls 2*b*, a pair of recess portions 2*e* each formed in the shape of a rectangular parallelepiped in a lower surface of the bottom wall 2*a*, holes 2*f* formed in the bottom wall 2*a* to provide communication between the receptacle portion 2*c* and the recess portions 2*e*, and depressions 2*g* formed respectively in upper surfaces of the recess portions 2*e*. The upper and lower cases 1, 2 are combined so that the receptacle portions 1*c* and 2*c* are opposed to each other, and are mounted together by a suitable means.

At this time, a single receptacle portion is formed by the receptacle portions 1*c* and 2*c* and the stepped portions 1*d* and 2*d* are fitted together. A packing 3 is disposed in the thus-fitted portion to seal the interiors of the receptacle portions 1*c* and 2*c*. In this way there is provided a waterproof structure against the entry of water, etc.

An antenna body 4 is made up of an earth plate 5, an antenna element 6 provided on the surface side of the earth plate 5 to receive a radio wave from a GPS satellite, a dielectric substrate 7 disposed on the back side of the earth plate 5 and with electric components (not shown) such as resistors, capacitors and IC parts mounted thereon, and a shielding case 8 for shielding the dielectric substrate 7 electrically.

The antenna body 4 is received within the sealed receptacle portions 1*c* and 2*c* in such a manner that the shield case 8 lies on the bottom wall 2*a* side of the lower case 2.

A waterproofing sleeve 10 is fitted on an outer surface of a coaxial cable 9. The coaxial cable 9 is mounted in a sandwiched state of the sleeve 10 between the upper and lower cases 1, 2 and it is connected to the dielectric substrate 7 and is drawn out to the exterior.

A pair of magnets 11 each in the shape of a rectangular parallelepiped are received respectively within the recess portions 2*e* of the lower case 2 and an adhesive 12 is applied into the depressions 2*g* and holes 2*f* formed in the recess portions 2*e*. With the adhesive 12, the magnets 11 and the shield case 8 as the antenna body 4 are bonded together and secured to the lower case 2.

In this case, since the adhesive 12 is present in the depressions 2*g*, the magnets 11 are bonded more firmly to the lower case 2.

Although in this first embodiment the depressions 2*g* are formed in an inclined state, the depressions 2*g* may be formed with a stepped portion as a substituted for such an inclined portion.

By utilizing the magnetism of the magnets 11 the GPS receiving antenna constructed as above is attached attractively to the outside of a moving object such as a ship or an automobile (the roof of an automobile, for example).

Figure 3:
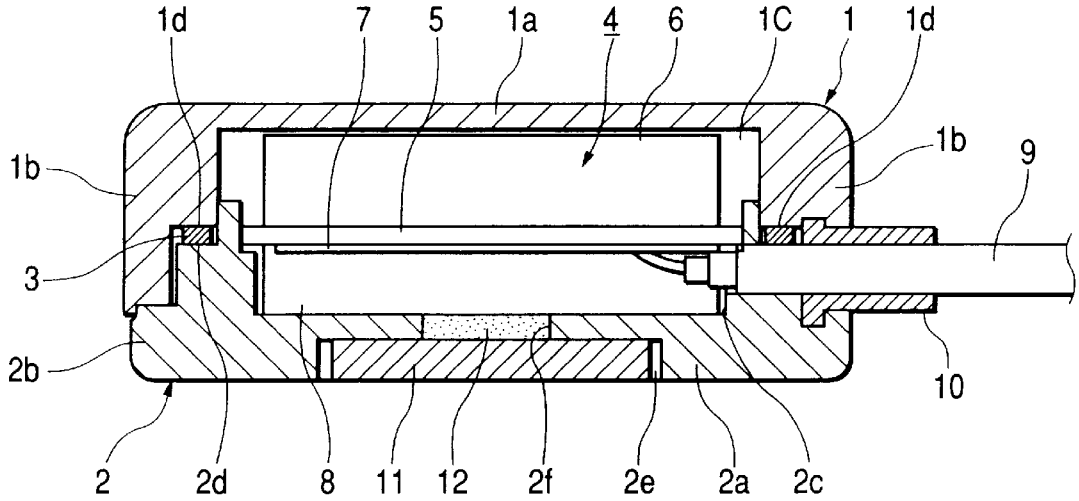
FIG. 3 is a sectional view of a principal portion of a GPS receiving antenna according to the second embodiment of the present invention.
Figure 4:
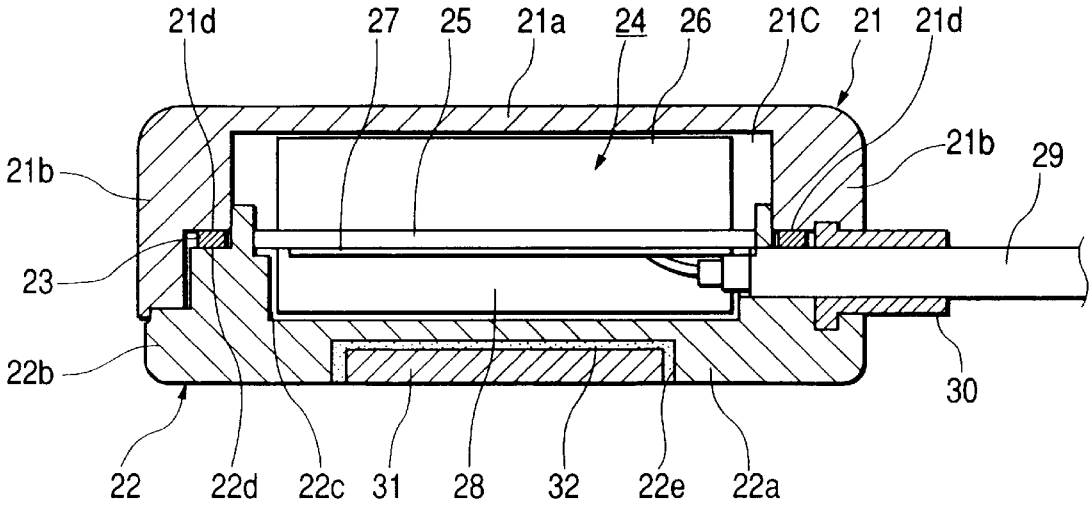
FIG. 4 PRIOR ART
FIG. 4 is a sectional view of a principal portion of a conventional GPS receiving antenna.
Figure 5:
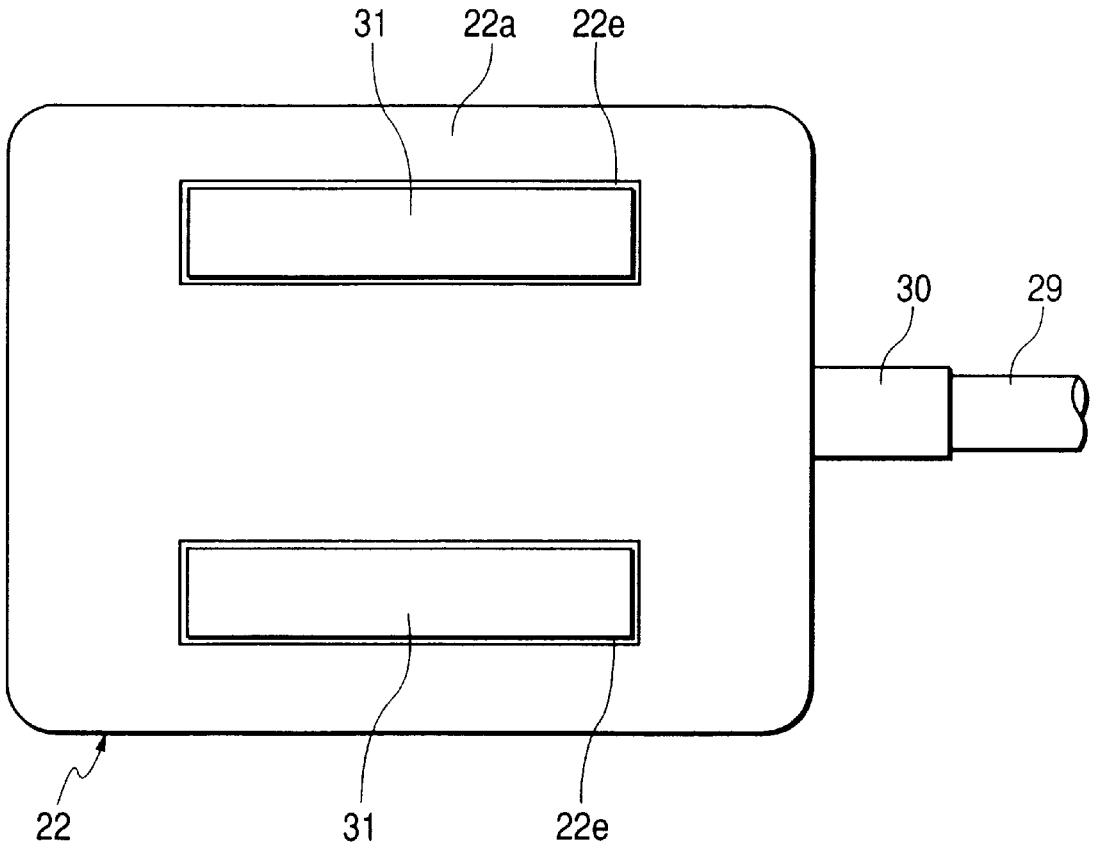
FIG. 5 PRIOR ART
FIG. 5 is a bottom view thereof.

Referring now to FIG. 3, there is illustrated a GPS receiving antenna according to the second embodiment of the present invention, in which the depressions 2*g* used in the previous first embodiment are not formed, but only holes 2*f* are formed. Other components in this second embodiment are the same as in the first embodiment, so will be identified by the same reference numerals as in the first embodiment and explanations thereof will here be omitted.

In the GPS receiving antenna according to the present invention, as set forth above, since holes 2*f* for communication between the recess portions 2*e* and the receptacle portion 2*c* are formed in the bottom wall 2*a* which defines the recess portions 2*e* and the antenna body 4 and the magnet 11 are bonded together through an adhesive applied into the holes 2*f*, the adhesive 12 does not protrude to the exterior of the recess portions 2*e*. Consequently, the appearance of the GPS receiving antenna is improved and a surface attraction of the magnets 11 is ensured, thus ensuring a more positive mounting of the antenna than in the prior art.

Further, since the depressions 2*g* are formed in the lower surface of the bottom wall 2*g* opposed to the magnets 11 and the adhesive 12 is present in the depressions 2*g*, the magnets 11 can be bonded to the case 2 more firmly.

What is claimed is:

1. A GPS receiving antenna comprising:

an upper case and a lower case;

an antenna body received in a receptacle portion formed by the upper and lower cases; and a magnet received in a recess portion formed in a lower surface of a bottom wall of the lower case and bonded to the lower case with an adhesive, wherein a hole for communication between the recess portion and the receptacle portion is formed in the bottom wall in which the recess portion is formed, and the adhesive is applied into the hole to bond the antenna body and the magnet with each other.

2. A GPS receiving antenna according to claim 1, wherein a depression is formed in the lower surface of the bottom wall opposed to the magnet so that the adhesive is present in the depression.

* * * * *